US005199456A

United States Patent [19]

Love et al.

[11] Patent Number: 5,199,456

[45] Date of Patent: Apr. 6, 1993

[54] SOLENOID GAS VALVE

[75] Inventors: John J. Love; Carl F. Fernstrom, both of St. Louis; Patrick S. Bauman, Ballwin; Ralph E. Banes, St. Louis, all of Mo.

[73] Assignee: Emerson Electric Co., St. Louis, Mo.

[21] Appl. No.: 939,667

[22] Filed: Sep. 3, 1992

[51] Int. Cl.[5] ..... E03B 1/00

[52] U.S. Cl. ..... 137/270; 137/269; 137/613; 251/367; 251/129.15

[58] Field of Search ..... 137/613, 269, 270; 251/367, 129.15; 29/157.1 R

[56] References Cited

U.S. PATENT DOCUMENTS

| | | | |
|---|---|---|---|
| 3,270,776 | 9/1966 | Carls | 137/270 |
| 4,306,853 | 12/1981 | Rippelmeyer | 431/66 |
| 4,424,830 | 1/1984 | Arensperger et al. | 137/613 |
| 4,563,133 | 1/1986 | Yasuhara | 417/295 |
| 4,727,899 | 3/1988 | Massey et al. | 137/270 |
| 4,938,258 | 7/1990 | Sato | 137/269 |
| 5,094,264 | 3/1992 | Miller | 137/270 |

*Primary Examiner*—A. Michael Chambers
*Attorney, Agent, or Firm*—Paul A. Becker, Sr.

[57] ABSTRACT

A gas valve includes two solenoid valves connected fluidically in series. A housing assembly contains a circuit board on which electrical components and a plurality of plug terminals and pin terminals are mounted. The plug terminals are adapted to be connected to the solenoid valves and the pin terminals are adapted to be connected to external circuitry. The housing assembly is adapted to be attached to the valve body either in a first position wherein the pin terminals extend in a first direction or in a second position wherein the pin terminals extend in a second direction. The housing assembly and the solenoid valves are adapted for enabling connection of the solenoid valves to the circuit board when the housing assembly is in either the first or second position. The solenoid valves are operated by direct current and are so mechanically constructed as to operate in a relatively quiet manner.

11 Claims, 3 Drawing Sheets

SOLENOID GAS VALVE

BACKGROUND OF THE INVENTION

This invention relates to solenoid gas valves, and particularly to an improved construction thereof which results in a gas valve which is compact, versatile, and relatively quiet in operation.

Gas valves comprising two solenoid valves connected fluidically in series have been known for many years. Such valves, in conjunction with externally connected electrical circuitry, are utilized to control gas flow to various gas-fired appliances, such as clothes dryers.

SUMMARY OF THE INVENTION

An object of this invention is to provide a generally new and improved gas valve comprising two solenoid valves which utilizes simple, convenient, and versatile connecting means between the solenoid valves and external electrical circuitry.

A further object is to provide such a gas valve wherein the solenoid valves operate in a relatively quiet manner.

In the preferred embodiment, each solenoid valve includes a movable metallic plunger and a co-axially mounted stationary metallic core member. One end of the plunger is connected to a resilient valve member which cooperates with a valve seat to control the flow of gas through the valve. A resilient washer mounted on the plunger cooperates with a cover plate having an opening through which the plunger reciprocates so as to limit the upward movement of the plunger and thereby prevent the other end of the plunger from hitting the core member when the plunger is pulled upwardly. Such construction thereby eliminates the clicking noise that would otherwise occur. Since the washer is resilient, contact of the washer with the cover plate generates essentially no noise. Furthermore, the electrical coils for effecting movement of the plungers are energized by direct current instead of alternating current, thereby eliminating the humming noise that is generally present, in some degree, in solenoid valves controlled by alternating current.

The circuit components for enabling direct current energizing of the electrical coils are mounted on a printed circuit board which is enclosed in a housing assembly connected to the gas valve. The circuit board is provided with plug terminals which accept pin terminals connected to the electrical coils. The circuit board is further provided with pin terminals for enabling convenient connections to external circuitry. The construction of various components of the gas valve is such that at the time the gas valve is manufactured, the housing assembly can be connected to the gas valve in either of two positions using the same gas valve components and simply assembling them in a different manner. This latter feature enables a choice of direction, a first direction or a second direction 180 degrees from the first direction, of the pin terminals to which external electrical circuitry is to be connected.

The above mentioned and other objects and features of the present invention will become apparent from the following description when read in conjunction with the accompanying drawings.

DESCRIPTION OF THE PREFERRED EMBODIMENT

The gas valve of this invention is similar to the gas valve shown and described in U.S. Pat. No. 4,424,830. In describing the present invention, some details of construction not pertinent to an understanding of the present invention are omitted for the sake of brevity. Reference may be made to the above patent for such details.

Figure 1:
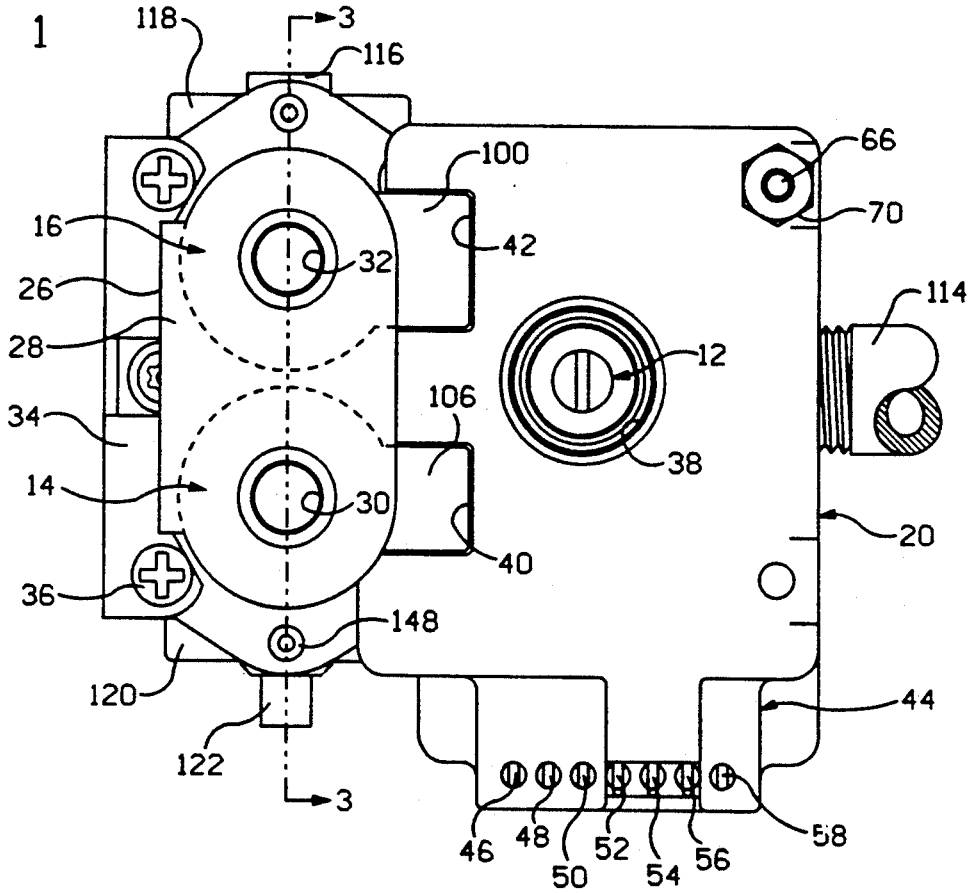
FIG. 1 is a top plan view of the gas valve constructed in accordance with the present invention.
Figure 2:
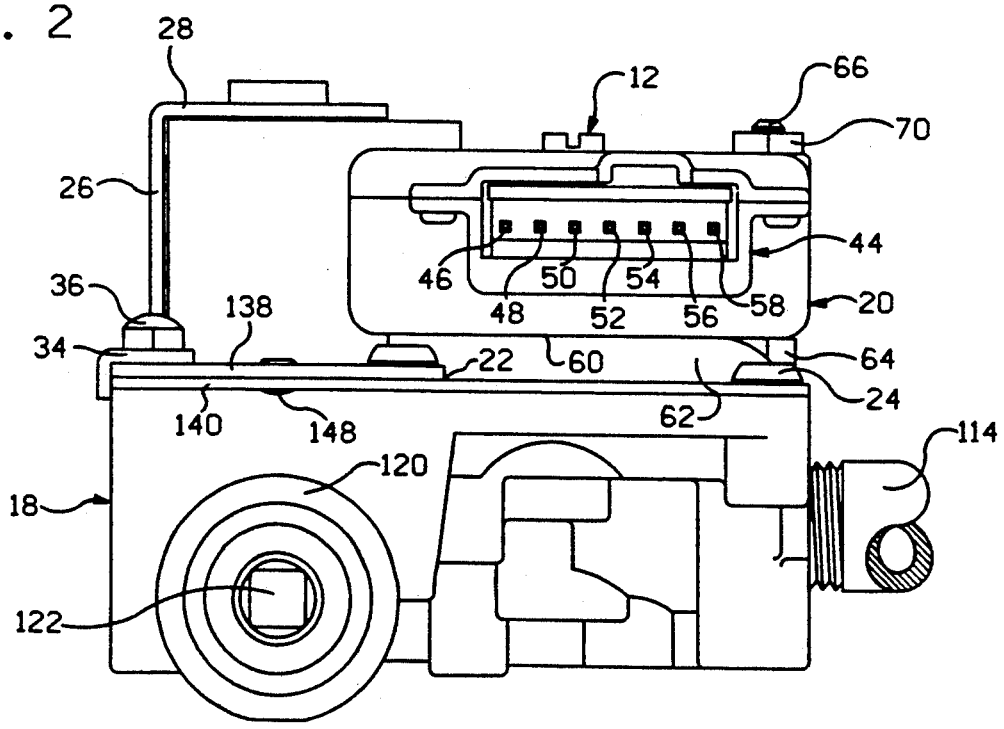
FIG. 2 is a front elevation view of the gas valve of FIG. 1.

Referring to FIGS. 1 and 2, the gas valve of this invention includes a pressure regulator indicated generally at 12 and two solenoid valves indicated generally at 14 and 16 positioned in a valve body indicated generally at 18. The gas valve further includes a housing assembly indicated generally at 20.

A cover plate assembly 22 is attached to valve body 18 by a plurality of tamper-resistant screws 24. Solenoid valves 14 and 16 are secured to valve body 18 by a bracket 26. A top leg 28 of bracket 26 is provided with extruded openings 30 and 32 into which portions of solenoid valves 14 and 16, respectively, extend. A bottom leg 34 of bracket 26 is secured to valve body 18 by screws 36 which extend through clearance openings (not shown) in cover plate assembly 22.

Housing assembly 20 is provided with a circular opening 38 through which a portion of pressure regulator 12 extends. As viewed in FIG. 1, housing assembly 20 further includes rectangular openings 40 and 42 into which portions of solenoid valves 14 and 16, respectively, extend so as to enable connection of solenoid valves 14 and 16 to housing assembly 20 in a manner hereinafter described. Housing assembly 20 further includes an end portion indicated generally at 44 adapted to provide means for connecting external electrical circuitry to pin terminals 46, 48, 50, 52, 54, 56 and 58 which extend outwardly from electrical circuitry contained within housing assembly 20.

As viewed in FIG. 2, the bottom surface 60 of housing assembly 20 rests on a raised portion 62 of cover plate assembly 22. Bottom surface 60 also rests on a lower hexagonal portion 64 of a threaded stud 66 which is connected to valve body 18 through a clearance opening (not shown) in cover plate assembly 22. Stud 66 extends through an opening 68 of housing assembly 20, referring to FIG. 5, and receives a nut 70 thereby rigidly securing housing assembly 20 to valve body 18.

Figure 6:
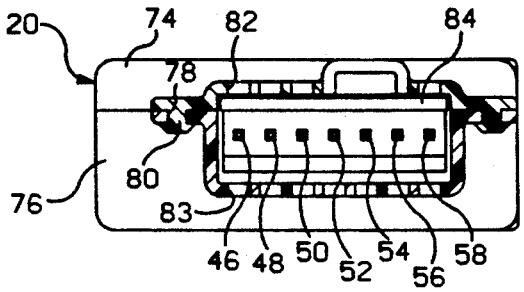
FIG. 6 is a cross-sectional view taken along line 6—6 of FIG. 5.

Referring to FIG. 6, housing assembly 20 comprises a top housing member 74 and a bottom housing member 76. Top housing member 74 is provided with the previously described openings 40 and 42. Top housing member 74 is provided with a plurality of circular posts which extend through openings 78 in bottom housing member 76 and are cold-headed as shown at 80 to secure the housing members 74 and 76 together. Top housing member 74 is provided with a plurality of circular openings 82 which are aligned with pin terminals 46, 48, 50 and 58, and bottom housing member 76 is provided with a plurality of like circular openings 83 which are aligned with pin terminals 46, 48, 50, 52, 54, 56 and 58. Openings 82 and 83 enable convenient access to such terminals for purposes of testing of the electrical circuitry contained within housing assembly 20.

Figure 8:
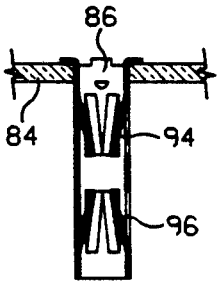
FIG. 8 is an enlarged cross-sectional view taken along line 8—8 of FIG. 5.

Electrical circuitry is mounted on a printed circuit board 84 contained within housing assembly 20. Circuit board 84 is provided with identical plug terminals 86, 88, 90 and 92 which, referring to FIGS. 5 and 8, extend downwardly from circuit board 84. Each of the plug terminals, as illustrated in FIG. 8 for plug terminal 86, is provided with a plurality of inwardly extending tabs 94 cantilevered from a position near the end of terminal 86 which is secured to circuit board 84, and a plurality of inwardly extending tabs 96 cantilevered from a position near the opposite end of terminal 86.

Figure 5:
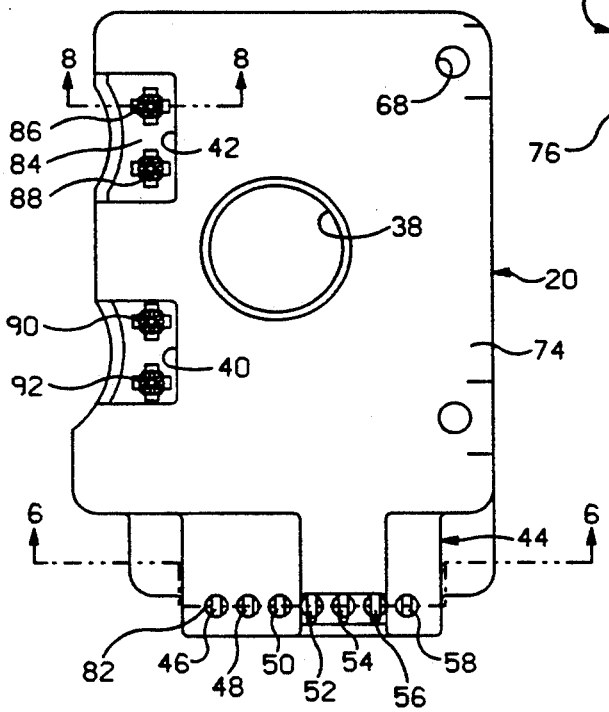
FIG. 5 is a top plan view of a housing assembly of the gas valve of FIG. 1 and shown with the housing assembly removed from the gas valve.
Figure 10:
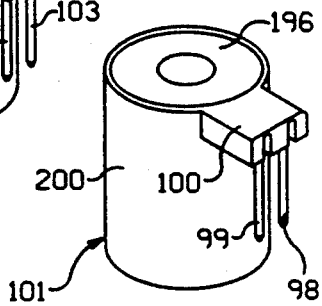

As viewed in FIG. 5, plug terminals 86 and 88 are adapted to receive pin terminals 98 and 99, respectively, which extend downwardly from a tab portion 100 of a coil assembly shown generally at 101 in FIG. 10. Coil assembly 101 is part of the construction of solenoid valve 16. As shown in FIG. 1, tab portion 100 is received within opening 42 of housing assembly 20.

Figure 11:
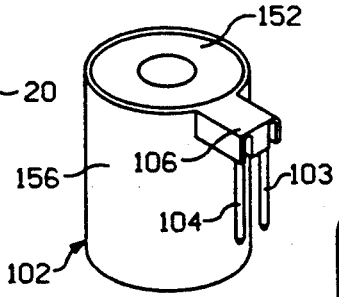
FIGS. 10 and 11 are perspective views of the electrical coil assemblies utilized in the gas valve of FIG. 1.

The coil assembly for solenoid valve 14, shown generally at 102 in FIG. 11, includes pin terminals 103 and 104 extending downwardly from a tab portion 106 for insertion into plug terminals 90 and 92, respectively. As shown in FIG. 1, tab portion 106 is received within opening 40 of housing assembly 20. Tab portion 100 is slightly wider than tab portion 106. Opening 40 of housing assembly 20 is sufficiently wide to receive tab portion 106 but not wide enough to receive tab portion 100. Such a construction ensures that coil assemblies 101 and 102 cannot be incorrectly connected to the electrical circuitry mounted on circuit board 84.

Figure 7:
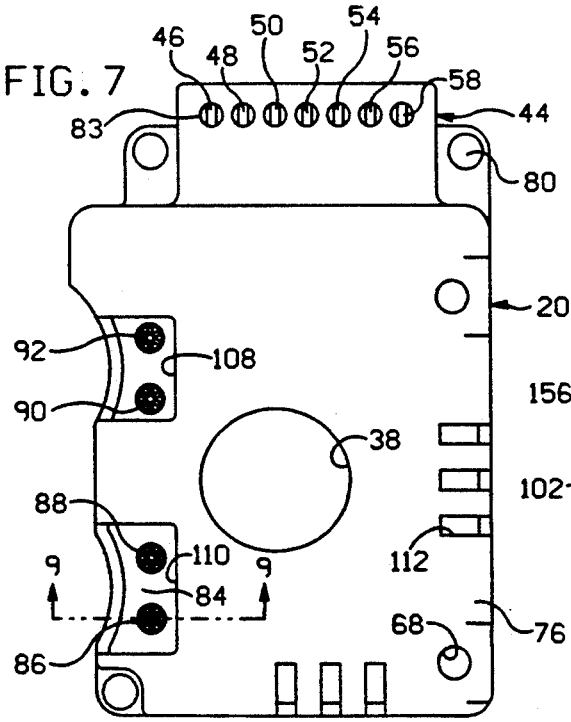
FIG. 7 is a top plan view of the housing assembly of FIG. 5 when the housing assembly is positioned to provide the pin terminals at a direction 180 degrees from the direction illustrated in FIG. 5.

A feature of the present invention is that at the time the gas valve is manufactured, housing assembly 20 can be connected to the valve body 18 so that pin terminals 46, 48, 50, 52, 54, 56 and 58 extend either in the direction shown in FIG. 1 or alternately, in a direction 180 degrees from the direction shown in FIG. 1. Specifically, if such alternate direction is desired, housing assembly 20 is turned end-over-end so that top housing member 74, instead of bottom housing member 76, is adjacent to the raised portion 62 of cover plate assembly 22. When in such alternate position, such alternate position being as shown in FIG. 7, housing assembly 20 is secured to valve body 18 by stud 66 and nut 70 through opening 68 and a clearance opening (not shown) in cover plate assembly 22.

Figure 9:
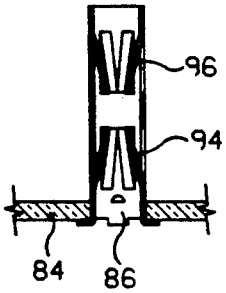
FIG. 9 is an enlarged cross-sectional view taken along line 9—9 of FIG. 7.

Bottom housing member 76 is provided with rectangular openings 108 and 110 identical to openings 40 and 42, respectively, in top housing portion 74. Bottom housing member 76 is also provided with a plurality of slots 112 for enabling dissipation to atmosphere of heat generated by the electrical components contained within housing assembly 20. When housing assembly 20 is mounted in such alternate position, the positions of solenoid valves 14 and 16 are reversed from that shown in FIG. 1. Specifically, with housing assembly 20 in such alternate position, tab portion 100 of solenoid valve 16 is received within opening 110, and tab portion 106 of solenoid valve 14 is received within opening 108. Plug terminals 86 and 88 receive pin terminals 99 and 98, respectively, of coil assembly 101 of solenoid valve 16. Similarly, plug terminals 90 and 92 receive pin terminals 104 and 103, respectively, of coil assembly 102 of solenoid valve 14. With housing assembly 20 in such alternate position, plug terminals 86, 88, 90 and 92 extend upwardly from circuit board 84 as illustrated in FIG. 9 for plug terminal 86.

The construction of plug terminals 86, 88, 90 and 92 is such that it facilitates insertion therein of pin terminals 98, 99, 103 and 104 regardless of the mounting position of housing assembly 20. Specifically, with housing assembly 20 mounted in the position shown in FIG. 1, pin terminals 98, 99, 103 and 104 enter plug terminals 86, 88, 90 and 92, respectively, at the terminal ends secured to circuit board 84, and tabs 94 provide a deflectable ramp so as to facilitate easy insertion. With housing assembly 20 mounted in the above-described alternate position, pin terminals 98, 99, 103 and 104 enter plug terminals 88, 86, 92 and 90, respectively, at the opposite ends of the plug terminals, and tabs 96 facilitate easy insertion.

Referring to FIGS. 1 and 2, gas flows into valve body 18 via a gas inlet conduit 114 and exits valve body 18 to a burner (not shown) through an orifice screw 116 threadedly engaged in an outlet boss 118 of valve body 18. Axially aligned with outlet boss 118 and extending from the side of valve body 18 opposite outlet boss 118 is a boss 120 in which a conventional pressure tap fitting 122 is threadedly engaged.

Pressure regulator 12 functions to maintain essentially the same rate of gas flow to the burner regardless of variations in the pressure of the gas entering gas valve body 18 through inlet conduit 114. The construction of pressure regulator 12 is fully shown and described in U.S. Pat. No. 4,424,830. Since the construction of pressure regulator 12 is not pertinent to an understanding of the present invention, a detailed explanation thereof is omitted. Reference may be made to the cited patent for such details.

Figure 3:
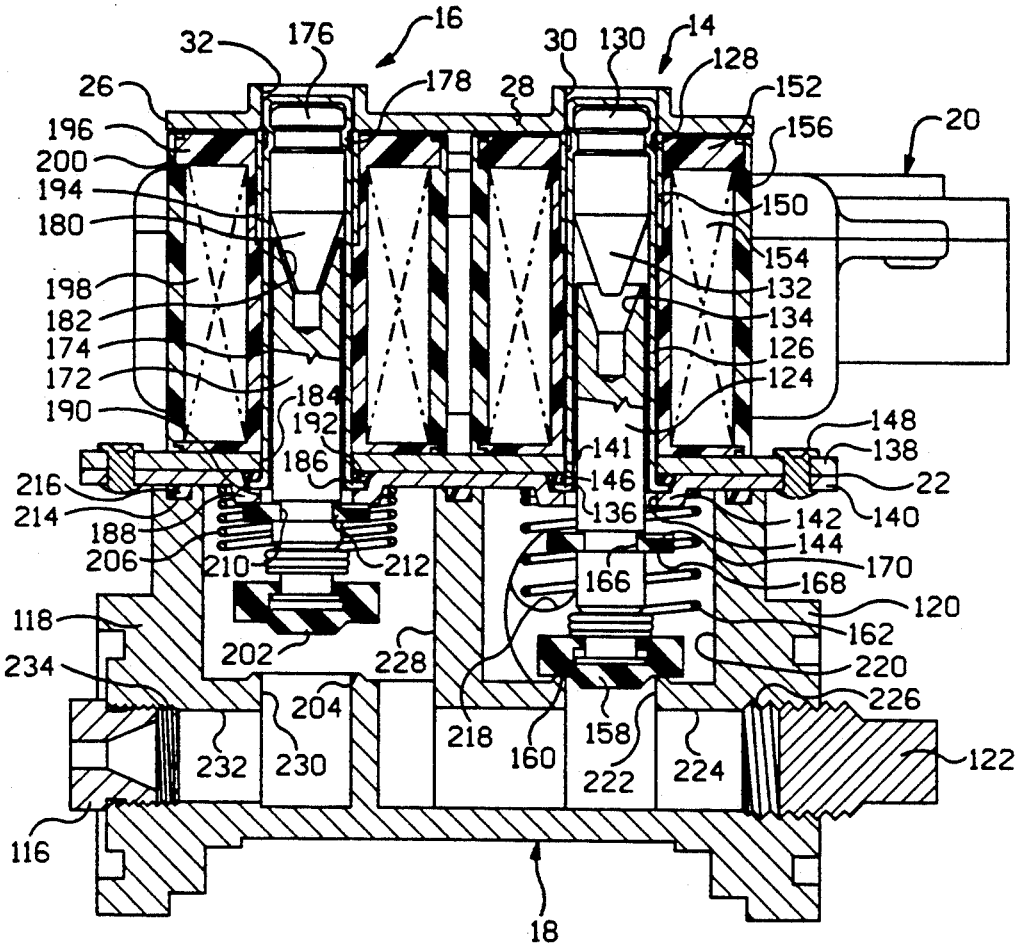
FIG. 3 is an enlarged cross-sectional view taken along line 3—3 of FIG. 1.

Referring to FIG. 3, solenoid valve 14 includes a metallic plunger 124 slidably received in a guide sleeve 126. Secured in an upper closed end of guide sleeve 126 by a press fit and by a peripheral deformation 128 is a metallic core member 130. The lower portion of core member 130 is provided with a conical extension 132. The upper portion of plunger 124 is provided with a conical recess 134.

The upper end of guide sleeve 126 extends into aperture 30 in top leg 28 of bracket 26. The lower end of guide sleeve 126 is open and flared outwardly at 136 to effect a gas-sealing resilient mounting of guide sleeve 126 to cover plate assembly 22. Specifically, cover plate assembly 22 comprises two plates 138 and 140. Plate 138 is flat and has an aperture 141 through which sleeve 126 extends. Plate 140 has a cup-shaped portion 142 with a centrally located aperture 144 through which plunger 124 extends. A compressible O-ring 146 is sandwiched between the flared end 136 of guide sleeve 126 and plate 138. The vertical spacing between plate 138 and the cup-shaped portion 142 of plate 140 is somewhat less than the combined thickness of flared end 136 and O-ring 146 in its uncompressed state so that when plates 138 and 140 are connected together, as by rivets 148, the O-ring 146 is compressed so as to provide a gas-sealing resilient mounting of guide sleeve 126.

Surrounding the upper end of guide sleeve 126 is a sleeve 150 which functions as an additional core member. A top portion of sleeve 150 abuts top leg 28 of bracket 26 and thereby provides an additional path for magnetic flux.

Surrounding sleeve 150 and guide sleeve 126 is a bobbin 152 on which is wound a wire coil 154 of an appropriate gauge and number of turns of wire. A rigid potting compound 156 encapsulates the portions of coil 154 that are not enclosed by bobbin 152. Referring to FIG. 11, potting compound 156 provides tab 106 out of which pin terminals 103 and 104 extend. The start and finish ends (not shown) of coil 154 are connected within tab 106 to pin terminals 103 and 104.

Attached to the lower end of plunger 124 is a resilient valve member 158. Valve member 158 cooperates with a valve seat 160 in valve body 18 and is biased to its closed position by a spring 162. Spring 162 is secured at one end to plunger 124 in a peripheral groove therein, and bears against the underside of plate 140 at its other end.

Secured in a peripheral groove 166 near the lower end of plunger 124 is a resilient washer 168. Washer 168 cooperates with the underside of cup-shaped portion 142 of plate 140 to limit the upward movement of plunger 124 so as to prevent the upper end of plunger 124 from hitting core member 130. Since washer 168 is resilient, such contact of washer 168 with portion 142 generates essentially no noise.

Core member 130 is so located and secured by peripheral deformation 128 as to provide a specific dimension between the lower portion of core member 130 and the underside of the flared end 136 of guide sleeve 126. The overall length of plunger 124 and the location of peripheral groove 166 in plunger 124 with respect to the upper end of plunger 124 are controlled to close tolerances. Such a construction ensures that the desired air gaps between the lower portion of core member 130 and the upper end of plunger 124 will be established when coil 154 is energized and when it is de-energized.

The top surface of washer 168 is provided with depressions 170 which extend inwardly from the periphery of washer 168 to a diameter less than the diameter of aperture 144 in cup-shaped portion 142 of plate 140. Depressions 170 ensure that when coil 154 is de-energized, valve member 158 will close. Specifically, depressions 170 prevent the development of a vacuum inside guide sleeve 126, which vacuum could prevent spring 162 from effecting the closing of valve member 158 when coil 154 is de-energized. Depressions 170 also minimize any tendency of washer 168 to stick to portion 142 due to mechanical adhesion.

Solenoid valve 16 is similar in construction to solenoid valve 14. Specifically, solenoid valve 16 includes a metallic plunger 172 slidably received in a guide sleeve 174. A metallic core member 176 is secured in an upper closed end of guide sleeve 174 by a press fit and by a peripheral deformation 178. The lower portion of core member 176 is provided with a conical extension 180. The upper end of plunger 172 is provided with a conical recess 182.

The upper end of guide sleeve 174 extends into aperture 32 in top leg 28 of bracket 26. The lower end of guide sleeve 174 extends through an aperture 184 in plate 138 and is flared outwardly at 186. Plate 140 includes another cup-shaped portion 188 with a centrally located aperture 190 through which plunger 172 extends. An O-ring 192 is sandwiched between the flared end 186 of guide sleeve 174 and plate 138. Core member 176 is located so as to provide the same dimension between the lower portion of core member 176 and the underside of the flared end 186 of guide sleeve 174 as is provided between the lower portion of core member 130 and the flared end 136 of guide sleeve 126 in solenoid valve 14.

A sleeve 194 surrounds the upper portion of guide sleeve 174 and abuts top leg 28 of bracket 26 so as to provide an additional path for magnetic flux. Surrounding sleeve 194 and guide sleeve 174 is a bobbin 196 on which is wound a wire coil 198 of an appropriate gauge and number of turns of wire. A rigid potting compound 200 encapsulates the portions of coil 198 that are not enclosed by bobbin 196. Referring to FIG. 10, the potting compound 200 provides tab 100 out of which pin terminals 98 and 99 extend. The start and finish ends (not shown) of coil 198 are connected within tab 100 to pin terminals 98 and 99.

Attached to the lower end of plunger 172 is a resilient valve member 202 which cooperates with a valve seat 204 in valve body 18 and is biased to its closed position by a spring 206. Spring 206 is secured at one end to plunger 172 in a peripheral groove therein, and bears against the underside of plate 140 at its other end.

Secured in a peripheral groove 210 near the lower end of plunger 172 is a resilient washer 212. Washer 212, identical in construction to washer 168 of solenoid valve 14, cooperates with the underside of cup-shaped portion 188 of plate 140 to limit the upward movement of plunger 172 so as to prevent the upper end of plunger 172 from hitting core member 176. Such contact of washer 212 with portion 188 generates essentially no noise. The overall length of plunger 172 and the location of peripheral groove 210 in plunger 172 with respect to the upper end of plunger 172 are controlled to close tolerances. Such construction, in conjunction with the previously described specific dimensioning of core member 176 within guide sleeve 174, ensures that the desired air gap between the lower portion of core member 176 and the upper end of plunger 172 will be established when coil 198 is energized and when it is de-energized.

As previously described, when it is desired to position housing assembly 20 opposite to that shown in FIG. 1, housing assembly 20 is turned end-over-end and the positions of solenoid valves 14 and 16 are reversed from that shown in FIG. 1. The reversal of the positions of solenoid valves 14 and 16 involves the reversal of the coil assemblies 101 and 102. Also, the assembly of plunger 124, valve member 158, washer 168 and spring 162 of solenoid valve 14 is reversed with the assembly of plunger 172, valve member 202, washer 212 and spring 206 of solenoid valve 16. It should be noted that such repositioning of housing assembly 20 and reversal of solenoid valves 14 and 16 requires no additional parts. It should also be noted that the previously described identical dimensioning of core member 130 in guide sleeve 126 and core member 176 in guide sleeve 174 enable such reversal without having to reverse the assembly of core member 130 and guide sleeve 126 and the assembly of core member 176 and guide sleeve 174. Also, since sleeves 150 and 194 are identical, they do not need to be reversed.

As previously described, cover plate assembly 22 is secured to valve body 18 by a plurality of tamper-resistant screws 24. Located in a groove 214 of valve body 18 and sandwiched between cover plate assembly 22 and valve body 18 is a gas sealing compressible ring 216. Preferably, groove 214 is contiguous with a groove which retains a regulator diaphragm (not shown), and ring 216 is contiguous with such diaphragm.

Inlet gas is regulated by pressure regulator 12. The regulated gas flows through a passageway 218 into a chamber 220 formed as a recess in valve body 18. The top of chamber 220 is defined by cover plate assembly 22. A bottom wall of chamber 220 is provided with a passageway 222 having valve seat 160 formed at the entrance thereof. Valve member 158 cooperates with valve seat 160 to control the flow of gas between chamber 220 and passageway 222. Passageway 222 is contiguous with a passageway 224. Pressure tap fitting 122 is attached to a threaded opening 226 in one end of passageway 224. The other end of passageway 224 leads into a chamber 228.

Chamber 228 is formed as a recess in valve body 18. The top of chamber 228 is defined by cover plate assembly 22. A bottom wall of chamber 228 is provided with a passageway 230 having valve seat 204 formed at the entrance thereof. Valve member 202 cooperates with valve seat 204 to control the flow of gas between chamber 228 and passageway 230. Passageway 230 is contiguous with a passageway 232. Orifice screw 116 is attached to a threaded opening 234 in passageway 232.

The gas valve of the present invention is intended for use in gas burner control systems of the type which utilize a hot surface igniter and a radiant heat sensing switch. While such systems can be utilized in a variety of gas-fired appliances, a system applicable to a clothes dryer is hereinafter described.

Figure 4:
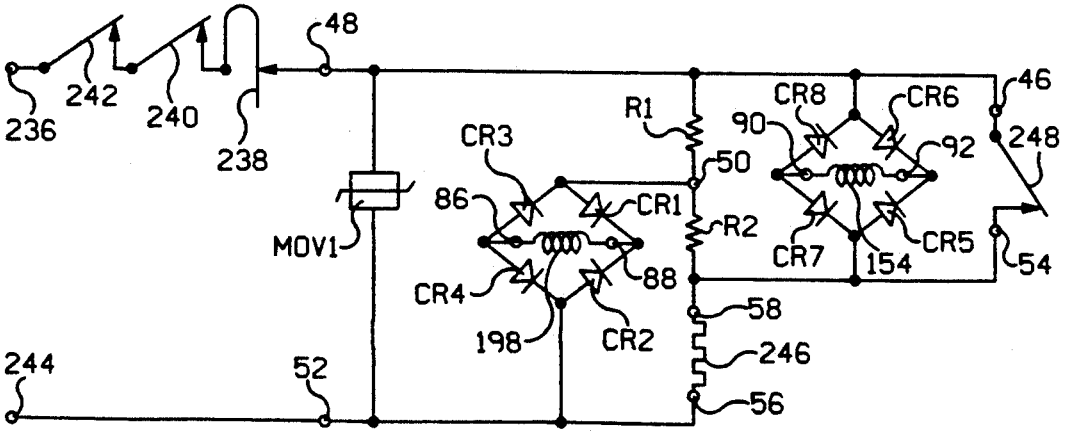
FIG. 4 is a wiring diagram illustrating the electrical components of the gas valve of FIG. 1 and connections thereof to external circuitry.

Referring to FIG. 4, the electrical circuitry contained within housing assembly 20 comprises resistors R1 and R2, controlled rectifiers CR1–CR8, and a metal oxide varistor MOV1. Also illustrated in FIG. 4 are plug terminals 86 and 88 to which coil 198 of solenoid valve 16 is connected, and plug terminals 90 and 92 to which coil 154 of solenoid valve 14 is connected. Also illustrated are pin terminals 46, 48, 50, 52, 54, 56 and 58 and the connections thereof to electrical circuitry within housing assembly 20 and to electrical circuitry external thereto.

Pin terminal 48 is connected to one side of a conventional 120 volt alternating current power source at terminal 236 through a thermostat switch 238, a dryer-door switch 240, and a timer-actuated switch 242. Pin terminal 52 is connected to the other side of the 120 volt power source at terminal 244.

Connected between pin terminals 56 and 58 is a hot surface igniter 246, and connected between pin terminals 46 and 54 is a radiant heat sensing switch 248.

Igniter 246 is positioned adjacent the burner (not shown) so as to effect ignition of the gas and to be impinged by the burner flame. Igniter 246, preferably a silicon-carbide device having a negative coefficient of temperature, requires a predetermined current flow therethrough to enable it to attain a temperature sufficiently high to ignite gas. When igniter 246 is at such ignition temperature, it emits a high intensity glow. When the current flow through igniter 246 is subsequently decreased to a value insufficient to enable igniter 246 to ignite gas, igniter 246 continues to emit a glow due to its being impinged by burner flame.

Radiant heat sensing switch 248, preferably a bimetallic device, is located with respect to the burner and igniter 246 so as to respond to the radiant energy emitted by burner flame and by glowing igniter 246. Switch 248 opens its contacts in response to the glow of igniter 246 when igniter 246 attains ignition temperature, and maintains its contacts open in response to burner flame and the glow of igniter 246 when igniter 246 is subsequently impinged by burner flame.

To initiate a burner cycle, the timer (not shown) is adjusted to the desired length of time the dryer is to operate, resulting in the closing of timer-actuated switch 242, and the dryer door is closed, resulting in the closing of door switch 240. Thermostat switch 238 is normally closed. With switches 238, 240 and 242 closed, igniter 246 is energized through switches 238, 240 and 242 and normally-closed switch 248 by the 120 volt alternating current power source at terminals 236 and 244. Under this condition, igniter 246 rapidly heats.

Concurrently, coil 198 of solenoid valve 16 is energized through rectifiers CR1–CR4 in series with a parallel circuit, one branch comprising resistor R1 and the other branch comprising resistor R2 in series with normally-closed switch 248. When power source terminal 236 is positive, current flows to coil 198 through rectifiers CR1 and CR4, and when terminal 236 is negative, current flows to coil 198 through rectifiers CR2 and CR3. This unidirectional or direct current flow is sufficient to enable coil 198 to effect upward movement of plunger 172, referring to FIG. 3, whereby valve member 202 is moved upwardly from its cooperative valve seat 204. Closed switch 248 effectively shunts coil 154 of solenoid valve 14 so that solenoid valve 14 remains closed. Therefore, even though solenoid valve 16 is open, gas cannot flow to the burner.

When igniter 246 reaches or preferably slightly exceeds gas ignition temperature, switch 248 opens in response to the radiant energy emitted by glowing igniter 246. With switch 248 open, coil 154 of solenoid valve 16 is energized through rectifiers CR5–CR8 in series with igniter 246. When power source terminal 236 is positive, current flows to coil 154 through rectifiers CR6 and CR7, and when terminal 236 is negative, current flows to coil 154 through rectifiers CR5 and CR8. This direct current flow is sufficient to enable coil 154 to effect upward movement of plunger 124, referring to FIG. 3, whereby valve member 158 is moved upwardly from its cooperative valve seat 160. Under this condition, gas flows to the burner.

When switch 248 opens, placing coil 154 in series with igniter 246, the current flow through igniter 246 decreases considerably. However, due to its mass, igniter 246 remains at gas ignition temperature for a sufficient time period to ignite gas at the burner.

Also occurring when switch 248 opens is a reduction in current flow through coil 198. Specifically, when switch 248 opens, energizing of coil 198 through switch 248 ceases, and coil 198 is subsequently energized primarily through resistor R1. Under this condition, the level of current flow through coil 198 is sufficient to maintain solenoid valve 16 open but insufficient to open it from a closed position.

When gas at the burner is ignited, switch 248 is responsive to the radiant energy emitted by the burner flame and flame-impinged igniter 246 to remain open. The burner remains on until at least one of the switches 238, 240 and 242 are opened, or until there is an interruption of electrical power at power source terminals 236 and 244.

Specifically, when one of the switches 238, 240 and 242 is opened, or when electrical power at terminals 236 and 244 is interrupted, coils 154 and 198 are immediately de-energized, causing solenoid valves 14 and 16 to immediately close. Also, igniter 246 is de-energized. The absence of burner flame enables switch 248 to cool and eventually close.

Timer-actuated switch 242 opens when the normal drying cycle is completed. Thermostat switch 238 opens when the temperature of the heated air or the products of combustion, or both, exceed a predetermined temperature. When burner operation is terminated by opening of switch 242 or 238, switch 248 generally has sufficient time to cool and close so that, upon reclosing of switch 242 or 238, a normal burner cycle is initiated.

When, however, burner operation is prematurely terminated by opening of door switch 240 or by an electrical power interruption at power source terminals 236 and 244, switch 248 may still be open when switch 240 is reclosed or power is restored. If switch 240 is reclosed or power is restored before switch 248 closes, coil 154 is energized to effect opening of solenoid valve 14, but coil 198, energized primarily through resistor R1, is not sufficiently energized to effect opening of solenoid valve 16. Therefore, no gas flows to the burner. Also, igniter 246, since it is in series with coil 154, is energized at a level insufficient to enable it to attain gas ignition temperature or to glow sufficiently to keep switch 248 open. Therefore, switch 248 continues to cool and eventually closes. When switch 248 closes, a normal burner cycle is initiated.

In solenoid valves controlled by alternating current, there is a cyclical reversal of the magnetic field generated by the coils therein. Such reversal effects a cyclical movement of movable parts therein, such as plungers, thereby generating some degree of a humming noise. Since coils 154 and 198 are operated by direct current, such humming noise is essentially eliminated. Such direct current operation, combined with the previously described construction wherein plungers 124 and 172 are prevented from hitting core members 130 and 176, respectively, ensures that solenoid valves 14 and 16 operate in a relatively quiet manner.

While the invention has been illustrated and described in detail in the drawings and foregoing description, it will be recognized that many changes and modifications will occur to those skilled in the art. It is therefore intended, by the appended claims, to cover any such changes and modifications as fall within the true spirit and scope of the invention.

We claim:

1. In a gas valve, a valve body having an inlet and an outlet;

two solenoid valves connected fluidically in series in said valve body for controlling flow of gas from said inlet to said outlet; and a housing assembly containing therein a circuit board on which electrical circuit components are mounted, said circuit board further including first terminal means for enabling connection of said solenoid valves to said circuit board and second terminal means for enabling connection of external electrical circuitry to said circuit board, said housing assembly being adapted for attachment to said valve body in a first position wherein said second terminal means extends in a first direction or in a second position wherein said second terminal means extends in a second direction, said housing assembly being further adapted for enabling said connection of said solenoid valves to said circuit board when said housing assembly is in either said first or said second position, said solenoid valves being adapted to be reversible in position in said valve body so as to provide said connection of said solenoid valves to said circuit board when said housing assembly is in either said first or said second position.

2. The gas valve claimed in claim 1 wherein said first terminal means comprises plug terminals and said solenoid valves include pin terminals cooperative with said plug terminals, said plug terminals being constructed so as to receive said pin terminals when said housing assembly is in either said first or said second position.

3. The gas valve claimed in claim 1 wherein each of said solenoid valves is operated by direct current.

4. The gas valve claimed in claim 3 wherein said electrical circuit components mounted on said circuit board include a plurality of controlled rectifiers for providing said direct current.

5. The gas valve claimed in claim 1 wherein each of said solenoid valves includes a wire coil, a movable plunger and a co-axially mounted core member, and a resilient washer attached to said plunger, said washer being effective to limit movement of said plunger, when said wire coil is energized, so as to prevent said plunger from hitting said core member.

6. The gas valve claimed in claim 5 wherein said each of said solenoid valves further includes a guide sleeve within which said core member is secured and within which said plunger is movable, said guide sleeve having an upper closed end and a lower open end, said core member being secured in said upper closed end by a press fit and a peripheral deformation so as to provide a specific dimension between a lower portion of said core member and a surface of said lower open end of said guide sleeve, and the overall length of said plunger and the location of said attached washer being so dimensioned that desired air gaps between said lower portion of said core member and an upper end of said plunger are established when said coil is energized and when it is de-energized.

7. In a gas valve, a valve body having an inlet and an outlet;

first and second solenoid valves connected fluidically in series in said valve body for controlling flow of gas from said inlet to said outlet, said first solenoid valve including a first coil assembly and said second solenoid valve including a second coil assembly;

a housing assembly having top and bottom members; and a circuit board contained within said housing assembly, said circuit board having electrical circuit components mounted thereon, said circuit board further having a plurality of pin terminals extending from said housing assembly for enabling connection of said electrical circuit components to external electrical circuitry, said circuit board further having first and second pairs of plug terminals in circuit with said electrical circuit components, said housing assembly being adapted for attachment to said valve body in a first position wherein said plurality of pin terminals extend in a first direction or in a second position wherein said plurality of pin terminals extend in a second direction, said top member of said housing assembly having a first opening therein for enabling connection of said first coil assembly to said first pair of plug terminals and a second opening therein for enabling connection of said second coil assembly to said second pair of plug terminals when said housing assembly is attached in said first position, said bottom member of said housing assembly having a third opening therein for enabling connection of said first coil assembly to said first pair of plug terminals and a fourth opening therein for enabling connection of said second coil assembly to said second pair of plug terminals when said housing assembly is attached in said second position, said solenoid valves being adapted to be assembled to said valve body in a first arrangement when said housing assembly is attached in said first position and in a second arrangement when said housing assembly is attached in said second position.

8. The gas valve claimed in claim 7 wherein one of said top and bottom members of said housing assembly is provided with posts extending through openings in the other of said members, said posts being cold-headed to secure said members together.

9. The gas valve claimed in claim 7 wherein said top and bottom members of said housing assembly are provided with openings aligned with said pin terminals, said openings enabling access to said pin terminals so as to enable testing of said electrical circuitry mounted on said circuit board.

10. The gas valve claimed in claim 7 wherein said first coil assembly includes a first pair of pin terminals extending therefrom and cooperative with said first pair of plug terminals, and said second coil assembly includes a second pair of pin terminals extending therefrom and cooperative with said second pair of plug terminals, each terminal of said first and second pairs of plug terminals having a plurality of deflectable tabs therein effective for facilitating insertion therein of said first and second pairs of pin terminals when said housing assembly is in either said first or said second position.

11. The gas valve claimed in claim 7 wherein each of said solenoid valves further includes a first assembly comprising a guide sleeve and core members, and a second assembly comprising a plunger, a valve member, a return spring, and a resilient washer, said second arrangement of said solenoid valves being effected by a reversal only of said coil assemblies and said second assemblies.

* * * * *